United States Patent [19]

Child

[11] Patent Number: 4,944,662

[45] Date of Patent: Jul. 31, 1990

[54] REVERSIBLE GEROTER PUMP WITH PIVOTING CARRIER UNIDIRECTIONAL FLOW

[75] Inventor: Robin E. Child, Leamington Spa, Great Britain

[73] Assignee: Concentric Pumps Limited, Birmingham, Great Britain

[21] Appl. No.: 311,937

[22] Filed: Feb. 16, 1989

[30] Foreign Application Priority Data

Feb. 26, 1988 [GB] United Kingdom ..... 8804582

[51] Int. Cl.[5] ..... F04C 2/10; F04C 15/02

[52] U.S. Cl. ..... 418/32; 418/171

[58] Field of Search ..... 418/32, 166, 172, 171; 417/315

[56] References Cited

U.S. PATENT DOCUMENTS 2,373,368 4/1945 Witchger ..... 418/32
2,458,678 6/1945 Bunte ..... 418/32
2,829,602 4/1958 Witcher ..... 418/32
4,171,192 10/1979 Taylor ..... 418/32
4,588,362 5/1986 Child ..... 418/32

*Primary Examiner*—John J. Vrablik
*Assistant Examiner*—David L. Cavanaugh
*Attorney, Agent, or Firm*—Stephen Donovan

[57] ABSTRACT

A reversible unidirectional flow gerotor pump (FIG. 1) has an externally cylindrical internally lobed rotor (36) internally meshed with an eccentrically located externally lobed male rotor having a smaller number of lobes (40) and the annulus runs in a cylindrical cavity in carrier ring 22 pivoted on pin 20 via slot 24. The carrier ring is located in a cylindrical cavity in the body of the pump and is free to translate along the line 18, with accompanied movement along the line 44, this movement occurring automatically when the direction of rotation of the driven rotor 40 is reversed, and resulting in continued pumping flow in the same direction through the pump.

5 Claims, 2 Drawing Sheets

REVERSIBLE GEROTER PUMP WITH PIVOTING CARRIER UNIDIRECTIONAL FLOW

Figure 1:
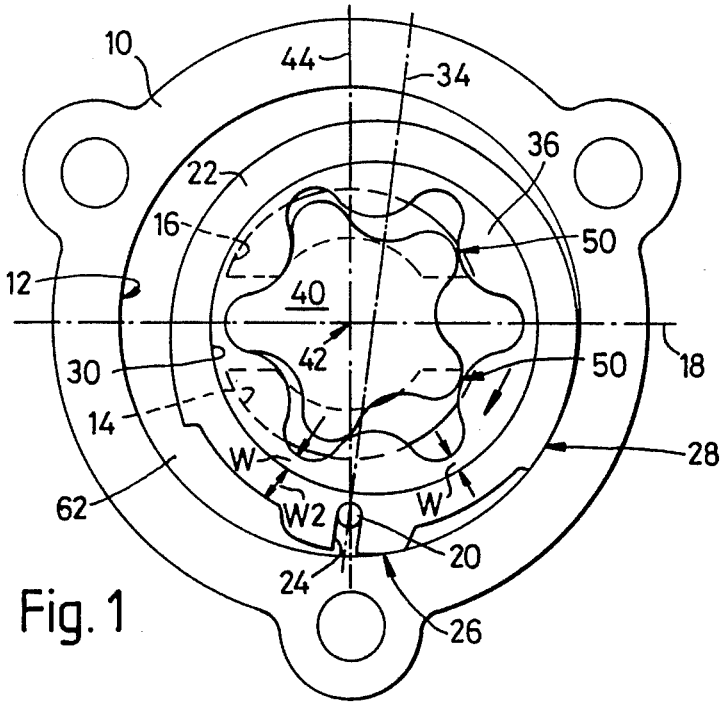

This invention relates to reversible uni-directional flow gerotor pumps of the kind described for example in EP No. 0 141 503. These pumps have the lobed male rotor meshed with an internally lobed or female annulus which has a greater number of lobes so as to create a series of working chambers between adjacent pairs of lobes of the rotor and adjacent pairs of lobes of the annulus. These chambers increase in size during rotation as they pass over an inlet port and decrease in size as they pass over an outlet port and hence fluid is sucked into the chambers and later expelled from them during the rotation.

If the direction of rotation of the pump is reversed, the inlet becomes the outlet and vice versa. But it is possible to avoid this and continue to draw in through the same inlet and expel through the same outlet, by shifting the eccentricity of the rotor and annulus along a line, which for practical purposes, may be considered to contain the axes of rotation of the rotor and annulus and extend between the respective inlet and outlet ports which are symmetrically located relative to such line.

The said EP No. 0 141 503 describes means for this shifting movement comprising a carrier ring pivoted on a pin so as to be capable of rocking generally in the direction of the length of that line. The carrier ring is externally non-circular so that effectively about one half of its periphery contacts the inner face of a cylindrical cavity in the body of the pump when the carrier ring is in the position for pumping in one direction of rotation of the rotor, and the opposite half of the periphery of the carrier ring contacts substantially the opposite half of the cavity when the carrier ring is in the other position for pumping in the opposite direction of rotation of the rotor. The interior periphery of the carrier ring, which carries and locates the annulus is similarly non-circular and this allows the annulus to move in the carrier and along an axis generally perpendicular to said line during the said movement. The movement of the annulus from one position to the other is automatic because of the fluid pressures generated within the chambers. These pressures tend to displace the annulus from one end to the other of carrier and also to rock the carrier ring from one side to the other of the pump cavity.

However, it has been found that in certain circumstances the pump of said EP No. 0 141 503 fails, that is to say the self reversing movement does not occur. Additionally, the carrier is expensive to produce because it is non-circular both internally and externally. The object of the invention is to solve these problems.

According to the invention a reversible uni-directional gerotor pump comprises an inner male toothed rotor located in a female lobed annulus which meshes with the inner rotor and rotates about an axis which is eccentrically related to the rotor axis, said annulus being located in a reversing ring or carrier which is in turn located in the body of the pump, and the axis of the annulus being moveable between a pair of operative positions in one of which liquid is pumped in a predetermined direction during rotation of the rotor and annulus in one direction and in the second of which liquid is pumped in the same direction during rotation of the rotor and annulus in the opposite direction, the reversing ring or carrier being shaped externally relative to the body of the pump so that it can pivot within the body of the pump to translate the annulus from one operative position to the other, and in so doing move form one side of the body to the other side of the body characterised in that the carrier is free to move in a direction perpendicular to a line joining the axis of the annulus in the two positions, said pivot comprising an elongated slot cooperating with a pivot pin, and said annulus being externally cylindrical and journalled in an internally cylindrical bore in said carrier.

Hence, the essential difference between the present invention and the EP is that whereas in the prior art the annulus moved relative to the carrier, now the annulus does not move relative to the carrier. Hence the carrier may be internally circular, and substantially so externally.

Figure 2:
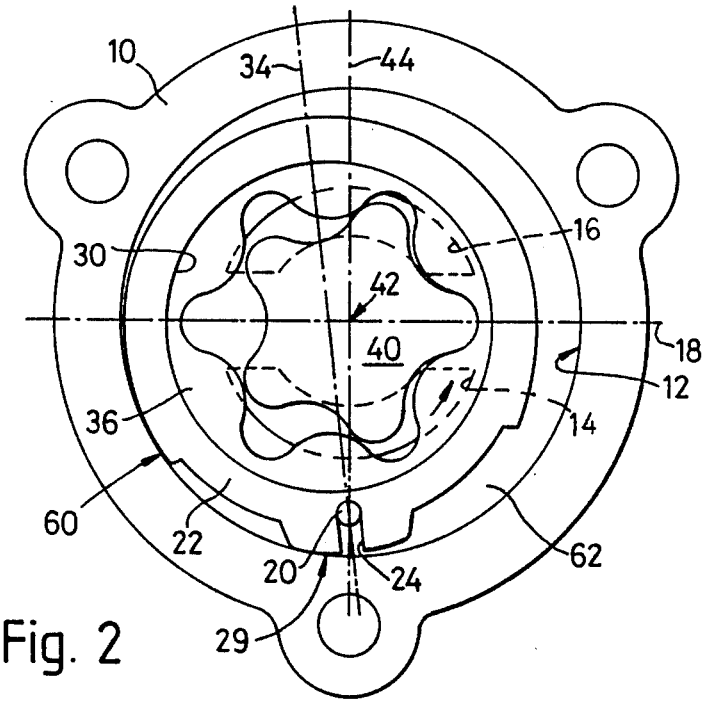
Figure 3:
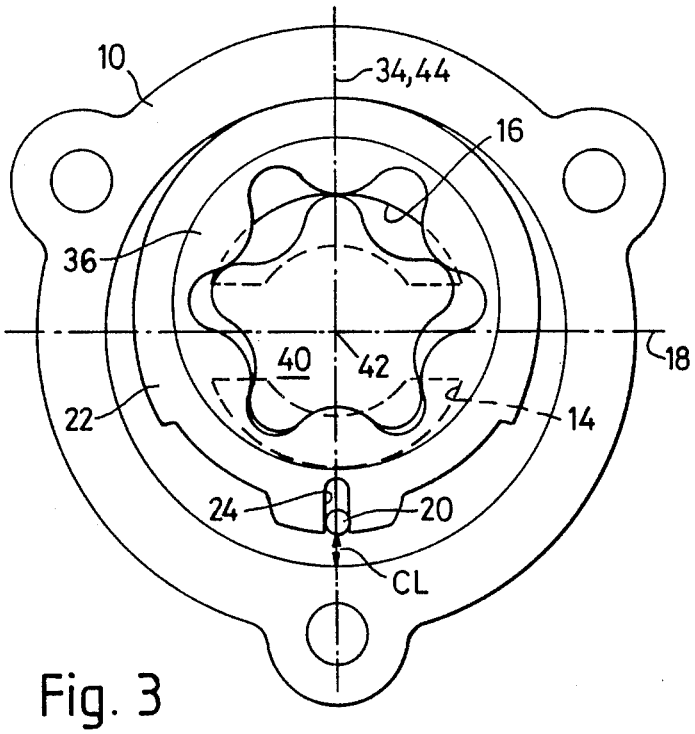

The invention is now more particularly described with reference to the accompanying drawings in which FIG. 1 is a somewhat diagrammatic view showing the pump of the present invention arranged for clockwise rotation;

FIG. 2 shows the same pump moved to a position for anti-clockwise rotation; and FIG. 3 shows the same pump in an intermediate position.

Referring now to the drawings in particular FIG. 1, the pump comprises a body 10 which has a cavity defined by cylindrical internal surface 12 extending between flat end faces which are normal to the axis of the cylindricality. The pump body is provided with a pair of ports 14 16 which are symmetrically located about a line 18. The pump is also provided with a pivot pin 20 which is fixed to the body.

The carrier ring or reversing ring 22 has an elongated slot 24 which engages the pin 20. It will be appreciated that the slot and pin can be reversed, that is to say the pin could provided on the ring and slot in the body, but the illustrated arrangement is preferred. The carrier ring is of an external shape, as more particularly described later herein that it can rest in a position shown in FIG. 1 and make contact with the chamber wall at the zones 26, immediately next to the slot 24, and 28 which is at an area angularly related thereto.

The internal shape of the carrier ring 22 is cylindrical at 30 and the axis of that cylindricality in FIG. 1, lies at the intersection of the said axis 18 and a second axis 34 which is generally perpendicular to axis 18 and also intersects the axis of the pin 20.

The annulus 36 is externally cylindrical so as to be journalled in the carrier ring with only the necessary clearance for rotation therein. Internally the annulus is lobed with, in this illustration, six teeth or lobes.

Inside the annulus is the rotor 40 which is similarly lobed but with less teeth: usually one less, and in the illustrated embodiment there are five lobes or teeth on the rotor. The rotor is driven by a shaft about an axis which may be the axis of cylindricality of the cavity wall 12, this axis being indicated by the reference numeral 42 and disposed at the intersection of line 44 and axis 18. Line 44 is truly perpendicular to line 18 and also intersects pin 20.

It will be seen that in FIG. 1 the port 16 is an inlet port and the port 14 is an outlet port: this is because the series of chambers formed between the successive lobes, which travel over the ports during rotation in a clockwise direction, increase in size as they travel over the port 16 and decrease in size as they travel over the port 14. Hence fluid is induced or sucked in at 16 and expelled at 14. The maximum pressure zone in the pump is in the chambers which are substantially aligned with the area between 26 and 28 where the carrier contacts the chamber wall. Reaction to the pressure is provided by the rotor, which runs on a fixed axis, and by the annulus carrier which is transmitted to the pump body at a point where the carrier and body are in contact. Hence, whilst the direction of rotation is as in FIG. 1, the parts are positively held in the FIG. 1 position by the generated pressure.

When the direction of rotation is reversed, whilst the parts remain in the FIG. 1 position, the port 16 becomes an outlet port and the port 14 an inlet port, because the chambers sweeping over the port 16 are reducing in size and hence fluid in them is expelled and vice verse in the case of the inlet port. The highest pressure then is located in chambers disposed between the rotor and the annulus and hence the carrier ring at a point where the carrier is free to move. Hence the generated pressure displaces the carrier to the FIG. 3 position which entails movement of the slot 24 over the pin 20, and then to the FIG. 2 position. As the parts pass through the FIG. 3 position, the inlet and outlet are automatically reversed because in the FIG. 3 position the chambers passing over the two ports first reduce in size and then increase in size whilst aligned with the same port. Hence the "outlet" port conveys a smaller volume of expelled fluid as the parts approach the FIG. 3 position and similarly the inlet port passes a smaller portion of induced fluid as the FIG. 3 position is approached, and when the FIG. 2 position is approached the reversal is completed because the chambers are once more of increasing size as they pass over port 16, which thus is the inlet and reduce in size as they pass over the second port 14 which is the outlet. The carrier and body abut in the zones 29 and 60 FIG. 2 to provide the reaction surface so that the parts are held in the FIG. 2 position as long as rotation in the anti-clockwise direction continues.

It is possible that the advantage afforded by the present invention is due to the different location of the cavities or spaces in the pump which are not important to the pump functioning but which are used for the reversal function. Thus, in the described pump of the present invention there is a space between the carrier ring exterior and the pump body interior but not elsewhere, apart from the working chambers of the pump conveying the pumped fluid. However in the prior art, it will be appreciated that there was a space between the annulus and the carrier ring to allow for movement of the carrier ring in the direction (which in the present pump is that of axis 44). The working chambers of the pump are effectively completed and closed by the end faces or side cheeks of the pump. There is a necessary working tolerance, creating a potential for fluid flow through that tolerance from the high pressure zone of the pump to a lower pressure zone. The length of that leakage path extends along a radius from the rotor axis over the distance between the lobes which define high pressure chambers and the external periphery of the annulus. In FIG. 1 this potential leakage path is of a length w indicated at two points on FIG. 1. However, fluid having leaked over the dimension w has not reached any substantial cavity but only the tolerance necessary for rotation of the annulus in the carrier, which is unimportant. For the leaked fluid to reach the cavity 62 in the pump it also has to flow over the distance corresponding to the width of the carrier ring at w2. This is a substantial distance. In contrast, in the prior art, the fluid only had to leak over the dimension w (and not w2) before it reached the cavity between the annulus and the inner periphery of the ring and hence that cavity could fill up with high pressure fluid which may have prevented the translational movement of the annulus in the carrier ring. This is completely avoided in the present invention. Moreover, in the event of leakage in the case of the present invention, so that the cavity 62 becomes filled, it will not interfere with movement of the carrier in the pump body in the same way because, as will be clear from consideration of the drawings, the carrier is exposed to that fluid over more than half of its periphery and hence movement is possible simply by displacing the fluid through generous sized gaps. In contrast again, in the prior art, the annulus was a close fit in the carrier over half its periphery and if the cavity over the other half were charged with fluid it would have been difficult for that fluid to displace around half of the periphery of the annulus.

I claim:

1. A reversible unidirectional gerotor pump comprising:

(a) an inner male toothed rotor;

(b) a female lobed annulus;

(c) a reversing ring or carrier;

(d) a pump body;

the rotor being located in the female lobed annulus, wherein the annulus meshes with the rotor, the annulus rotates about an axis which is eccentrically related to the rotor axis, and the annulus is located in the reversing ring or carrier, the reversing ring or carrier being located in the pump body, and the axis of the annulus being moveable between a pair of operative positions in one of which liquid is pumped in a pre-determined direction during rotation of the rotor and annulus in one direction and in the second position at which liquid is pumped in the same direction during rotation of the rotor and annulus in the opposite direction, the reversing ring or carrier being shaped externally relative to the body of the pump so that it can pivot about a pivot means within the body of the pump to translate the annulus from one operative position to the other, to thereby move from one side of the body to the other side of the body, the carrier being free to move in a direction perpendicular to a line joining the axis of the annulus in the two positions, the pivot means comprising an elongated slot cooperating with a pivot pin, and the annulus being externally cylindrical and journalled in an internally cylindrical bore in the carrier.

2. A pump as claimed in claim 1 wherein said carrier is provided with the elongated slot and the pivot pin is fixed in the body of the pump.

3. A pump as claimed in claim 2 wherein the elongated slot is open ended.

4. A pump as claimed in claim 1 wherein the body of the pump provides a cylindrical chamber housing the carrier ring and said ring has a pair of zones immediately next to the slot and on opposite sides of the same, either one of which zones contacts the body of the pump according to which of two alternate positions is occupied by the carrier.

5. A pump as claimed in claim 4 wherein each said zone is angularly spaced from a further area of the carrier disposed to contact the pump body and the carrier ring is relieved externally over the area substantially aligned with the maximum pressure zone in the pump.

* * * * *